US012624599B2

(12) United States Patent
Jamieson

(10) Patent No.: US 12,624,599 B2
(45) Date of Patent: May 12, 2026

(54) DRILLING APPARATUS AND RELATED METHODS

(71) Applicant: Helmerich & Payne Technologies, LLC, Tulsa, OK (US)

(72) Inventor: Angus Lamberton Jamieson, Inverness (GB)

(73) Assignee: Helmerich & Payne Technologies, LLC, Tulsa, OK (US)

( * ) Notice: Subject to any disclaimer, the term of this patent is extended or adjusted under 35 U.S.C. 154(b) by 0 days.

(21) Appl. No.: 18/900,526

(22) Filed: Sep. 27, 2024

(65) Prior Publication Data

US 2025/0109641 A1 Apr. 3, 2025

Related U.S. Application Data

(60) Provisional application No. 63/586,324, filed on Sep. 28, 2023.

(51) Int. Cl.
*E21B 17/10* (2006.01)
*E21B 17/05* (2006.01)

(52) U.S. Cl.
CPC ..... *E21B 17/1078* (2013.01); *E21B 17/05* (2013.01); *E21B 17/1014* (2013.01)

(58) Field of Classification Search
CPC ... E21B 17/1078; E21B 17/05; E21B 17/1014
See application file for complete search history.

(56) References Cited

U.S. PATENT DOCUMENTS 2,173,309 A * 9/1939 Monroe ..... E21B 7/10 175/76
3,370,657 A * 2/1968 Antle ..... E21B 7/062 175/321
5,265,684 A * 11/1993 Rosenhauch ..... E21B 17/1078 175/325.2

(Continued)

*Primary Examiner* — Neel Girish Patel
(74) *Attorney, Agent, or Firm* — Kilpatrick Townsend & Stockton LLP

(57) ABSTRACT

According to embodiments of the present disclosure a drilling sub apparatus that may be coupled to a drill pipe. The drilling sub apparatus may have a pendulum member that moves from a first position to a second position. In the first position, a bottom region of the pendulum member covers or seals apertures that thereby close a fluid pathway from an inner region of the drilling sub apparatus through elements of the drilling sub apparatus through to one or more chambers between a pendulum sleeve and a stabilizer sleeve of the drilling sub apparatus. In the second position, the bottom region of the pendulum member may uncover or unseal from apertures that thereby open the fluid pathway from an inner region of the drilling sub apparatus through elements of the drilling sub apparatus through to the one or more chambers. The fluid that flows from the inner region to the one or more chambers may exert a force on an inner pipe of the drilling sub apparatus, and thereby on the drill pipe, to move the drill pipe towards a vertical position. The pendulum member may move between the first and second positions in response to the angle of the drilling sub apparatus relative to a force of gravity and may do so without the use of electronics, communication channels, or the like.

21 Claims, 9 Drawing Sheets

(56) References Cited

U.S. PATENT DOCUMENTS

| | | | | |
|---|---|---|---|---|
| 5,996,712 | A * | 12/1999 | Boyd | E21B 17/025 166/242.7 |
| 10,047,562 | B1 * | 8/2018 | Cherrington | E21B 21/12 |
| 2014/0209389 | A1 * | 7/2014 | Sugiura | E21B 7/067 175/73 |
| 2016/0281431 | A1 * | 9/2016 | Peters | E21B 47/024 |
| 2018/0016845 | A1 * | 1/2018 | Peters | E21B 44/00 |
| 2020/0392792 | A1 * | 12/2020 | Peters | E21B 7/068 |
| 2022/0178206 | A1 * | 6/2022 | Peters | E21B 47/024 |

* cited by examiner

DRILLING APPARATUS AND RELATED METHODS

CROSS-REFERENCES TO RELATED APPLICATIONS

This present application claims the benefit of priority to U.S. provisional patent application No. 63/586,324 filed on Sep. 28, 2023, titled "Pendulum sub apparatus", the entirety of which is hereby incorporated by reference for all purposes. The disclosure of this application is related to the disclosure in U.S. patent application Ser. No. 17/823,485, filed Aug. 30, 2022, and titled "Systems and Methods for Drilling Geothermal Wells," which is hereby incorporated by reference as if fully set forth herein. In addition, the present disclosure is also related to the disclosure in U.S. patent application Ser. No. 18/189,918, filed on Mar. 24, 2023, and titled "Methods and Apparatus for Bitless Drilling," which is hereby incorporated by reference as if fully set forth herein.

BACKGROUND OF THE DISCLOSURE

Drilling a wellbore for the extraction of minerals has become an increasingly complicated operation due to the increased depth and complexity of many wellbores. Drilling is an expensive operation and errors in drilling add to the cost and, in some cases, drilling errors may permanently lower the output of a well for years into the future. Conventional technologies and methods may not adequately address the complicated nature of drilling, and may not be capable of gathering and processing various information from downhole sensors and surface control systems in a timely manner, in order to improve drilling operations and minimize drilling errors. Drilling operations can be conducted by having a rotating drill bit mounted on a bottom hole assembly (BHA) that gives direction to the drill bit for cutting through geological formations and enabled steerable drilling. During drilling of a borehole steering can be difficult and the drilling pipe may move away from a desired vertical position due to a variety of reasons. In many situations, measurements while drilling (MWD) can be used to determine a bottom hole assembly's (BHA) position. In aspects of the present disclosure, a drilling apparatus may be positioned between a BHA and a drill bit, in some aspects the drilling apparatus may be positioned between a BHA and a drill string. In some aspects, one or more drilling apparatus may be positioned between a BHA and a drill bit, or between a BHA and a drill string. Typically, surveys are taken periodically during drilling with the MWD equipment and the data collected by the MWD equipment is used to determine the current location of the BHA. By determining the present and past locations of the BHA, one can determine if the wellbore has deviated from a vertical direction (or orientation) and by how much, then take corrective steps.

In some wells, however, the MWD equipment may not be useful and/or may not provide reliable data. For example, typical MWD sensors (e.g., accelerometers) and/or other sensors and items in the BHA may have temperature limits (e.g., 175 degrees Celsius), above which the MWD equipment may not work or may not be reliable. In some wells, such as deeper drilling depths or wells drilled for geothermal energy, the formations to be drilled may be at temperatures greater than the temperature limit of the MWD sensors or other BHA equipment, such as formations at 250 degrees Celsius or greater. In such cases, it may be difficult to accurately monitor and thereby control the trajectory of the wellbore while it is being drilled and it may not be possible to rely on MWD equipment (e.g. sensors) to provide data for the position of the BHA.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE DISCLOSURE

Figure 1:
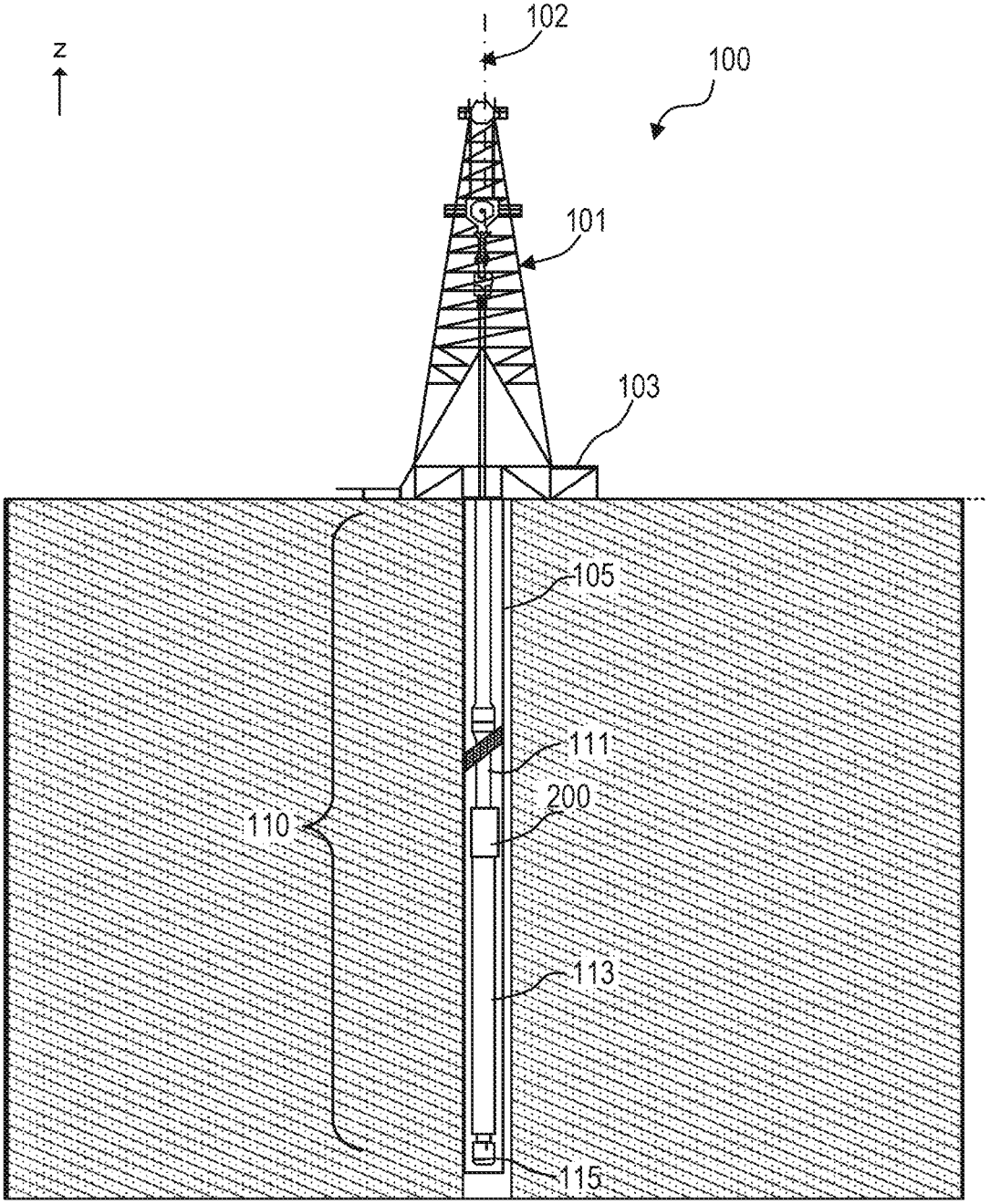
FIG. 1 illustrates a drilling system for drilling a borehole, the system including a drill rig with a drill string including a bottom home assembly, according to embodiments of the disclosure.

Throughout this description for the purposes of explanation, numerous specific details are set forth to provide a thorough understanding of the many aspects and embodiments disclosed herein. It will be apparent, however, to one skilled in the art that the many aspects and embodiments may be practiced without some of these specific details. In other instances, known structures and devices are shown in diagram or schematic form to avoid obscuring the underlying principles of the described aspects and embodiments. This disclosure is related to the disclosure in U.S. patent application Ser. No. 17/823,485, filed Aug. 30, 2022, and titled "Systems and Methods for Drilling Geothermal Wells," which is hereby incorporated by reference as if fully set forth herein. In addition, the present disclosure is related to the disclosure in U.S. patent application Ser. No. 18/189,918, filed on Mar. 24, 2023, and titled "Methods and Apparatus for Bitless Drilling," which is hereby incorporated by reference as if fully set forth herein.

As used herein, unless otherwise specified the term "Vertical" or "Vertical Position" means positioned between 80 degrees and 100 degrees relative to the z-axis defined with respect to a plumb line or an axis aligned with the force of gravity. In some embodiments, the z-axis may correspond to a longitudinal axis of a wellbore. As used herein, the term "Substantially Vertical" or a "Substantially Vertical Position" means positioned between 70 degrees and 110 degrees relative to the z-axis defined with respect to a plumb line or the force of gravity.

In the present disclosure, though references are made herein to geothermal drilling, the assemblies and methods disclosed herein are contemplated to be used in conventional drilling as well. Solutions directed to maintaining verticality of the drill pipe during drilling using materials that can withstand the higher temperatures often found downhole, are desirable, and non-limiting examples of such solutions are provided herein. During drilling, the drill pipe (or drill string) may move between a first position and a second position. In the first position, the drill pipe may be substantially vertical or vertical (which may be defined in relation to gravity, or a plumb line, or in some cases a wellbore orientation). In the second position, the drill pipe may not be substantially vertical or vertical. According to embodiments of the present disclosure a drilling sub apparatus (may be referred to as a sub apparatus, a drilling apparatus, a pendulum apparatus, a pendulum sub apparatus, or a sub apparatus herein) coupled directly or indirectly to a drill pipe can, in response to the drill pipe moving from the first position to the second position, allow fluid to flow from an inner region of an inner pipe of the sub apparatus through fluid pathways to one or more chambers positioned between a stabilizer sleeve and a pendulum sleeve of the sub apparatus. The fluid within the one or more chambers may exert a force against a side surface of the inner pipe in a direction opposite the direction of tilting. The movement of the drill pipe away from a vertical or substantially vertical position can cause one or more elements of the drilling sub apparatus to also move away from the vertical or substantially vertical position, thereby opening or closing the fluid pathway for allowing or preventing fluid to flow to the one or more chambers. Thus, the drilling sub apparatus may exert a force on the drill pipe automatically or without the use of electronics. In other words, the fluid, when permitted to flow to the one or more chambers in response to the drill pipe (and thereby an inner pipe of the drilling sub apparatus) moving away from a vertical or substantially vertical position can provide a force against the inner pipe of the sub apparatus to force the inner pipe (and thereby the drill pipe) back towards a vertical position.

As described above, and with reference to the figures below, a force provided by fluid within one or more chambers may be applied in response to the tilting (moving away from a vertical or a substantially vertical orientation or axis) of the inner pipe without the use of electronics, including but not limited to accelerometers, sensors, and the like. For example, the drilling sub apparatus may be purely mechanical and need not require the use of electronics, communication channels, or the like to apply the force against the side surface of the inner pipe to move the inner pipe towards or into a vertical position or substantially vertical position. The force may be provided by establishing a fluid pathway (or fluid communication) (e.g., via apertures, openings, or fluid passageways) between different components of the sub apparatus when the inner pipe is tilted away from a vertical or substantially vertical position. For example, when the inner pipe tilts away from the vertical axis, the pendulum may move relative to the pendulum sleeve to expose one or more apertures that extend through the pendulum sleeve. The exposure of the one or more apertures may allow fluid under pressure within the inner pipe to flow from within the inner pipe to the one or more chambers between the pendulum sleeve and the stabilizer sleeve. The build-up of pressure within the one or more discrete chambers may create an opposing force that forces the inner pipe back towards the vertical or substantially vertical position. Once the inner pipe is vertical or substantially vertical, additional apertures in the stabilizer sleeve can allow the high pressure with the one or more chambers to slowly dissipate to alleviate the pressure and thereby reduce the force on the inner pipe in response to the inner pipe (and thereby the drill pipe) returning to a vertical or substantially vertical position.

FIG. 1 illustrates a non-limiting embodiment of a drilling rig system 100. The rig system 100 includes a rig structure 101 and a drill string 110. The rig structure 101 can be above the ground and configured support the drill string 110. The drill string 110 can be configured to drill a wellbore 105 within the ground. The drill string 110 can include one or more drill pipes (or pipes) 111 coupled to each other, a bottom hole assembly (BHA) 113, and a drill bit 115. In various embodiments, the drill string 110 can be coupled to a sub apparatus 200 (also referred as a pendulum sub assembly) to maintain reasonable verticality of the wellbore 105 during the drilling. As shown, the sub apparatus 200 can be coupled along a length of the pipe 111. In the illustrated embodiment, the sub apparatus 200 can be coupled to a top side of the BHA 113, while the drill bit 115 is attached to the bottom of the BHA 113. Alternatively, the bottom hole assembly 113 may be coupled on an opposite end of the drill bit 115 from the sub apparatus 200, with the upper side of the BHA 113 attached to the pipe 111 of the drill string 110. In other words, the sub apparatus 200 may be coupled between the BHA 113 and the drill bit 115. For example, the BHA 113 can be coupled to the top end of the sub apparatus 200 and the drill bit 115 can be coupled at the bottom end (opposite to the top end) of the sub apparatus 200.

During drilling, the drill string 110 may stray from a specified vertical axis 102 (or vertical position) due to geological formations or variations, for example. Once the drill string 110 begins to stray from the vertical position, gravity may encourage the drill string 110 to tilt further away from the vertical position. The vertical axis 102 can be a longitudinal axis of a vertical wellbore 105 desired to be drilled within the ground which may correspond with a force of gravity (e.g. a plumb line defined by a z-axis). In some embodiments, the vertical position may correspond to a vertical axis perpendicular to the rig floor 103. In some embodiments, the vertical axis 102 can be aligned with a longitudinal axis of the drill string 110. Maintaining vertical alignment of the drill string 110 during can be advantageous to prevent pipe breaks, deviation of a desired drill path of the wellbore 105, case of backing up the drill string 110 for maintenance (e.g., pipe replacement, drill bit replacement, etc.), or other operational advantages.

Figure 2:
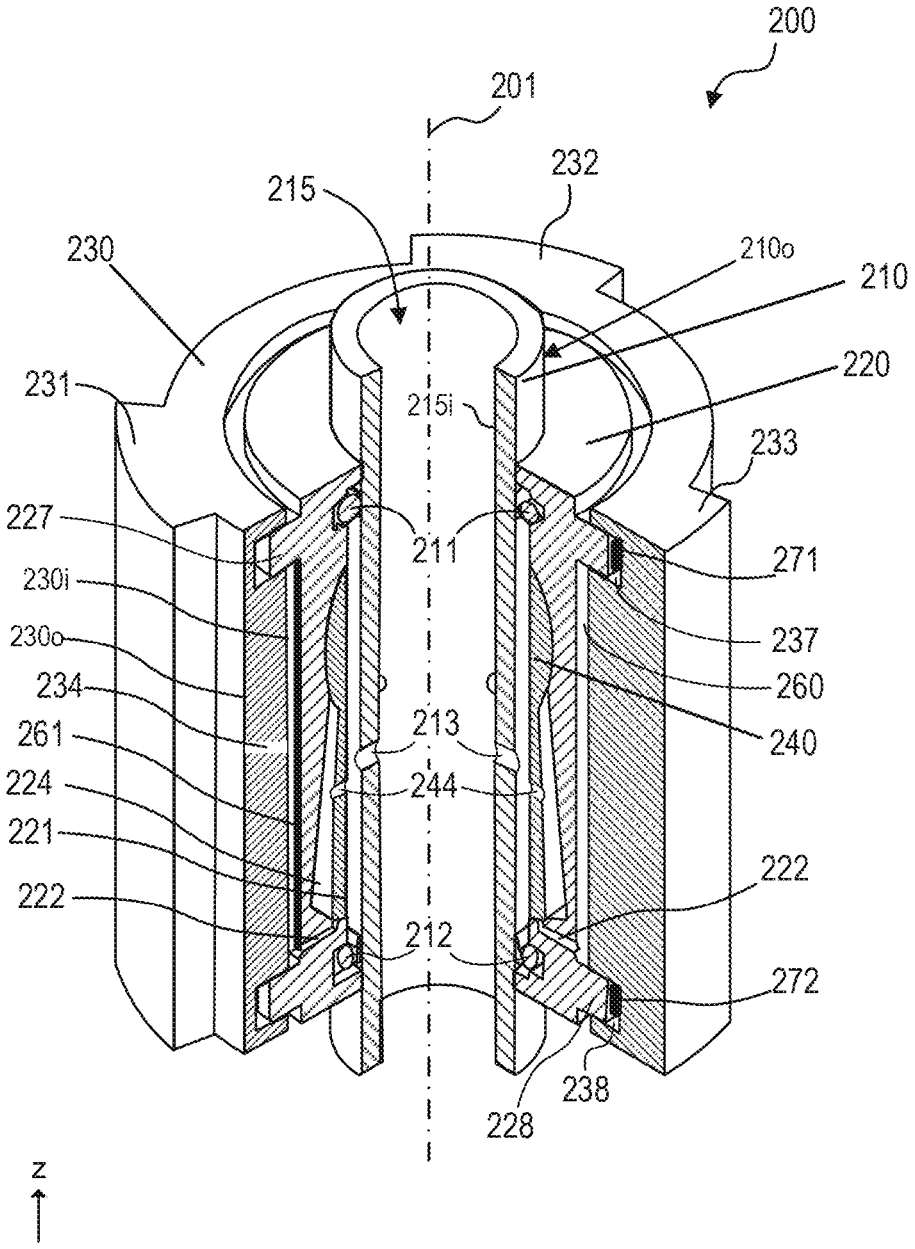
FIG. 2 is a cross-sectional view of a pendulum sub assembly, according to embodiments of the disclosure, couplable to the bottom hole assembly of FIG. 1.

FIG. 2 illustrates a non-limiting exemplary embodiment of the sub apparatus 200 for aiding in maintaining reasonable verticality of the wellbore 105 (shown in FIG. 1), according to aspects of the present disclosure. The sub apparatus 200 can includes an inner pipe 210 positioned within a pendulum sleeve 220, which itself may be positioned within a stabilizer sleeve 230. A pendulum member 240 (also referred as a pendulum 240) may be positioned within an inner region of the pendulum sleeve 220 such that it surrounds the inner pipe 210. The inner pipe 210 extends along a longitudinal axis 201. The inner pipe 210 can be configured to rotate relative to the pendulum sleeve 220. In various embodiments, the inner pipe 210 can be coupled to the pipe 111 (shown in FIG. 1) (e.g. the pipe that defines the drill string) so that the longitudinal axis 201 aligns with the pipe 111 of the drill string 110 (shown in FIG. 1).

During drilling, in response to the inner pipe 210 becoming tilted away from the vertical axis 102, the sub apparatus 200 can provide a force against a side surface of an inner pipe 210 in a direction opposite the direction of tilting. In other words, the sub apparatus 200 can provide a force against the side surface of the inner pipe 210 to force the inner pipe 210 back towards a vertical position (e.g. aligned with the vertical axis 102 of a wellbore 105 or z-axis) in response to the inner pipe's longitudinal axis 201 straying from the vertical axis 102. The force may be applied in response to the tilting of the inner pipe 210 without the use of electronics, including but not limited to accelerometers, sensors, and the like. For example, the apparatus 200 may be purely mechanical and need not require the use of electronics, communication channels, or the like to apply the force against the side surface of the inner pipe 210 to move the inner pipe 210 into a vertical position in which it is aligned with the vertical axis (e.g., 102).

The force may be provided by establishing fluid communication (e.g., via apertures, openings, or fluid passageways) between different components 210, 220, 230, and 240 of the sub apparatus 200 when the inner pipe 210 is tilted relative to the vertical axis (e.g., 102). For example, when the inner pipe 210 tilts away from the vertical axis (e.g. 102), the pendulum 240 may move relative to the pendulum sleeve 220 to expose one or more apertures that extend through the pendulum sleeve 220. The exposure of the one or more apertures may allow fluid under pressure within the inner pipe 210 to flow from within the inner pipe 210 to one or more discrete chambers (e.g. 260) between the pendulum sleeve 220 and the stabilizer sleeve 230. The build-up of pressure within the one or more discrete chambers (e.g. 260) may create an opposing force that forces the inner pipe 210 back towards the vertical axis (e.g. 102). Once the inner pipe 210 is vertically aligned, apertures in the stabilizer sleeve 230 can allow the high pressure to slowly dissipate to alleviate the pressure and thereby the force on the inner pipe 210.

Figure 9A:
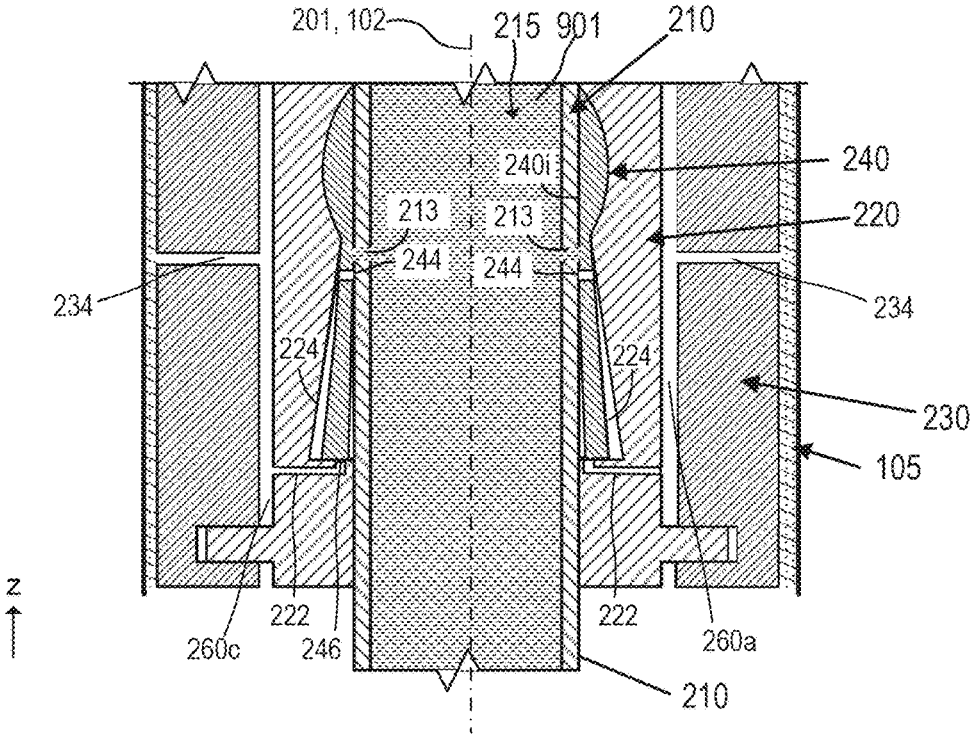
FIG. 9A illustrate a cross-section portion of the pendulum sub assembly of FIG. 2 in a vertical position, according to embodiments of the disclosure.
Figure 9B:
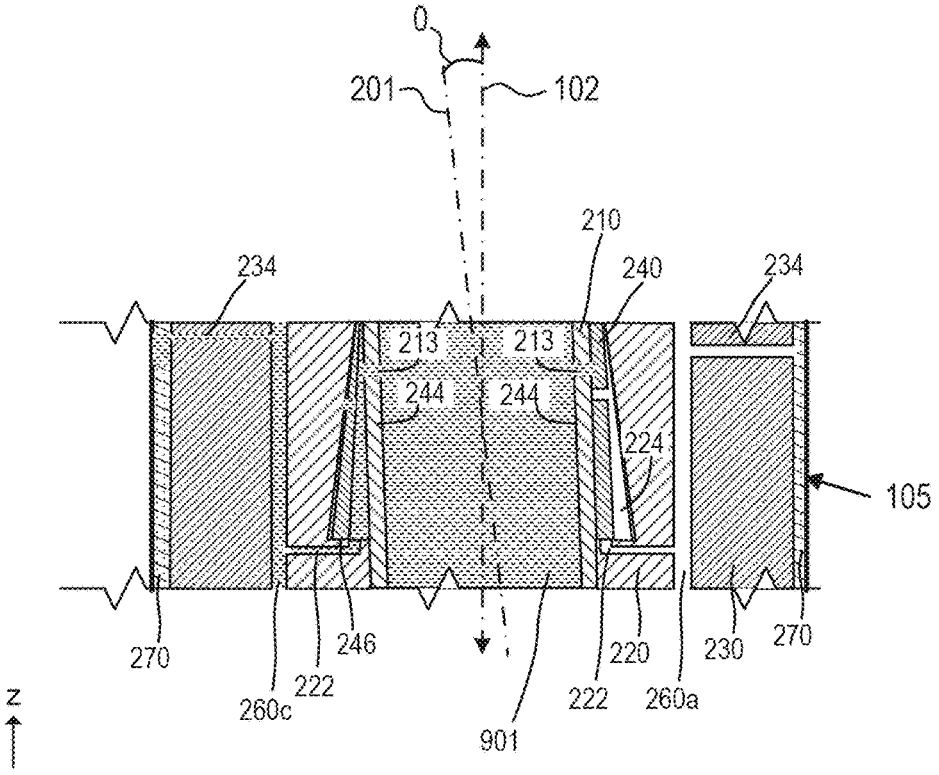
FIG. 9B illustrate a cross-section portion of the pendulum sub assembly of FIG. 2 in a tilted position, according to embodiments of the disclosure.

According to embodiments of the present disclosure, the sub apparatus 200 may include one or more apertures or openings (e.g., 213, 222, 244) defining fluid passageways that may extend from an inner surface to an outer surface of the inner pipe 210, the pendulum 240, and the pendulum sleeve 220, respectively. A flow path from the inner region 215 of the inner pipe 210 to the one or more discrete chambers 260 may be covered (or sealed or blocked) preventing high pressure from flowing from the inner pipe 210 to the one or more discrete chambers 260 when the inner pipe 210 is substantially vertical (e.g., aligned to the vertical axis 102), as shown in FIG. 9A. However, when the inner pipe 210 is tilted relative to the vertical axis 102, the pendulum member 240 may, by force of gravity, rotate relative to the pendulum sleeve 220. The movement of the pendulum member 240 may uncover or unblock one or more apertures 222 which may provide for fluid communication between the inner region of the inner pipe 210 and the one or more discrete chambers 260, as shown in FIG. 9B. Thus, the flow of pressure from the inner region 215 of the inner pipe 210 through the various fluid passageways defined by the components 210, 220, 230, and 240 of the sub apparatus 200 may be controlled via exposing or blocking the one or more apertures 222 in the pendulum sleeve 220 by way of the position of the pendulum 240 within the pendulum sleeve 220.

Figure 3B:
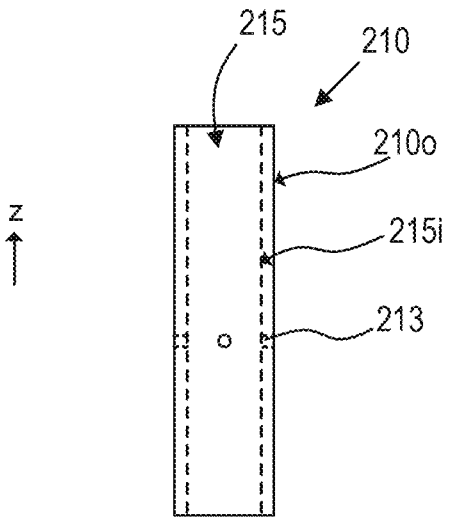
FIGS. 3A, 3B, and 3C are a perspective view, an elevation view, and a plan view, respectively, of an inner pipe located within the pendulum sub assembly of FIG. 2, according to embodiments of the disclosure.
Figure 3A:
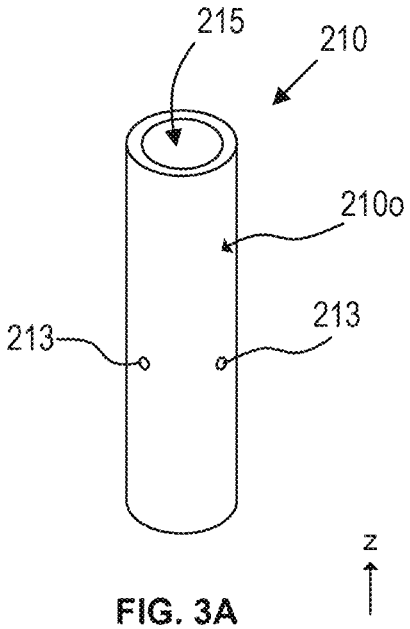
Figure 3C:
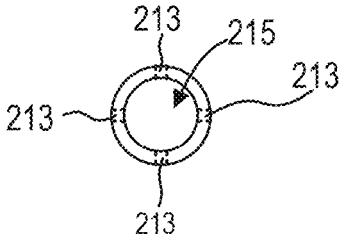

FIGS. 3A-3C depict additional views of an exemplary non-limiting inner pipe 210 according to embodiments of the present disclosure. The inner pipe 210 can be a hollow cylindrical in shape having an inner region or through hole 215 extending along a longitudinal axis from a first end (e.g., top end) to a second end (e.g., a bottom end) opposite the first end of the inner pipe 210. The inner pipe 210 can include one or more apertures or openings 213 extending from an inner surface 215*i* defining the through hole 215 of the inner pipe 210 to the external surface 2100 of the inner pipe 210. The apertures (e.g. 213) define a fluid passageway through which a fluid (e.g., drilling fluid including drilling mud, air, other gases) may flow from the inner region 215 to the external surface 2100 of the inner pipe 210. In the illustrated embodiment, four apertures 213 (see FIG. 3C) may be radially distributed along the perimeter of the inner pipe 210. Although, only four apertures are illustrated, more than four or fewer than four apertures may be provided without limiting the scope of the present disclosure. Diameters of each of the apertures 213 can be same. In some embodiments, the apertures 213 can be sized relative to diameters of apertures of an adjacent component (e.g., the pendulum sleeve 220).

Figure 4B:
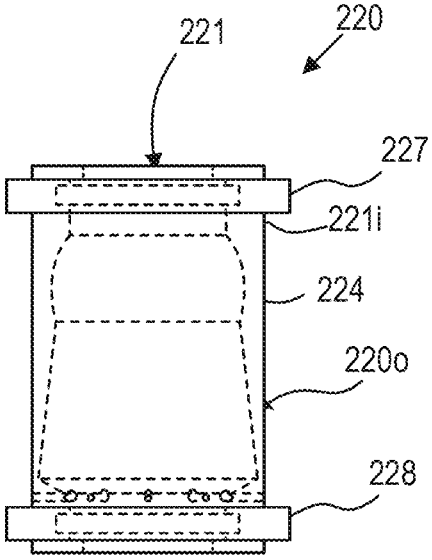
FIGS. 4A, 4B, and 4C are a perspective view, an elevation view, and a plan view, respectively, of a pendulum within the pendulum sub assembly of FIG. 2, according to embodiments of the disclosure.
Figure 4A:
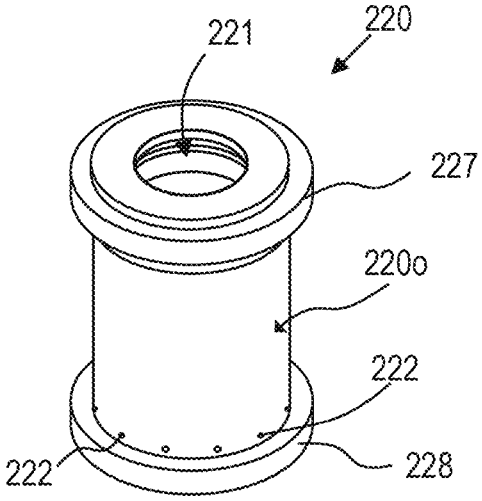
Figure 4C:
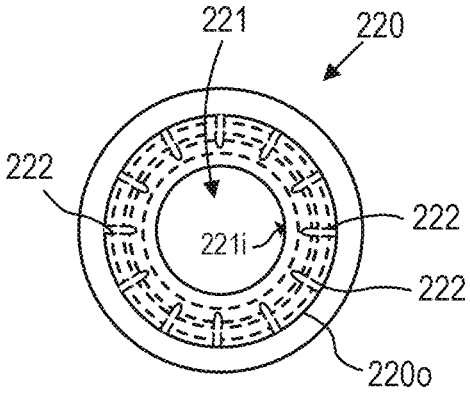

FIGS. 4A-4C, depict additional views of a non-limiting exemplary pendulum sleeve 220 according to embodiments of the present disclosure. The pendulum sleeve 220 can include a through hole (or opening) 221 extending along a longitudinal axis from a first end (e.g. top end) to a second end (e.g. a bottom end) of the pendulum sleeve 220. The through hole 221 can be sized and shaped to receive the inner pipe 210 therethrough. One or more bearings 211, 212 can be positioned at a first and a second end of the pendulum sleeve 220 to facilitate rotation of the inner pipe 210 relative to the pendulum sleeve 220 (see FIG. 2).

Figure 7:
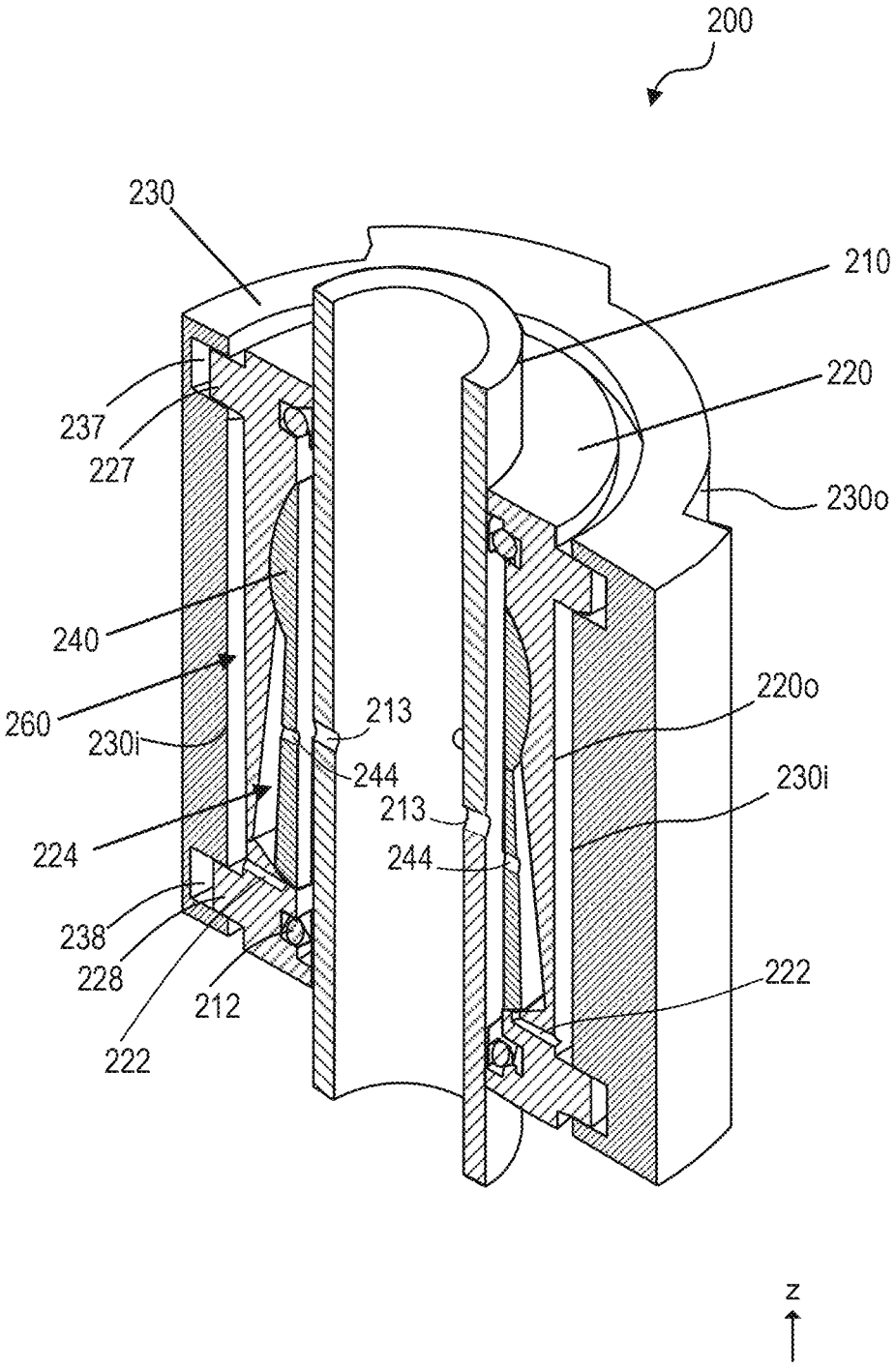
FIG. 7 is another cross-sectional view of the pendulum sub assembly of FIG. 2 in different orientation, according to embodiments of the disclosure.

An inner surface 221*i* (see FIGS. 4B and 4C) of the pendulum sleeve 220, in addition to defining the through hole 221, can further define a pendulum recess 224 (or pendulum chamber) (see also FIG. 7), The pendulum recess 224 can be sized and shaped to receive the pendulum 240. The pendulum 240 may be movable within to the pendulum recess 224 such that it may freely rotate in response to the force of gravity. The pendulum recess 224 can have a shape corresponding to an external shape of the pendulum 240. Accordingly, the pendulum recess 224 can allow the pendulum 240 to move within the pendulum recess 224 while retaining the pendulum 240 within the pendulum sleeve 220. For example, as shown in FIG. 4B, the pendulum recess 224 can be shaped to include a top spherical portion 241 and a bottom conical portion 242 extending from the spherical portion such that the pendulum 240 may swing or rotate about its top spherical portion 241 within the pendulum recess 224, which in turn may move the bottom conical portion 242 within the pendulum recess 224. In other words, the spherical upper portion 241 when placed within the pendulum recess 224 can serve as a ball and socket joint. This allows the pendulum 240 to pivot about a longitudinal axis (e.g., 102) within the pendulum recess 224. For example, the pendulum member 240 may be movable within the pendulum recess 224 of the pendulum sleeve 220 when the pendulum sleeve 220 is not in a vertical position (e.g., the vertical axis 102 in FIG. 1). As referenced above, and discussed further below, the movement of the bottom conical portion 242 of the pendulum 240 may move between a first position in which (a) in the bottom portion of the pendulum covers apertures extending from the inner surface 220*i* of the pendulum sleeve to the outer surface 220*o* of the pendulum sleeve 220 and a second position in which (b) the bottom portion of the pendulum has shifted such that it no longer covers at least one of the apertures extending from the inner surface 220*i* of the pendulum sleeve to the outer surface 220*o* of the pendulum sleeve 220.

The pendulum sleeve 220 can be sized and shaped to be positioned within an inner region or longitudinally extending inner opening 235 of the stabilizer sleeve 230. In some embodiments, the pendulum sleeve 220 and the stabilizer sleeve 230 may be coupled together such that there remains an annulus space (or chamber) 260 (see FIG. 7) between the pendulum sleeve 220 and the stabilizer sleeve 230. In some embodiments, the pendulum sleeve 220 can include flanges 227, 228 receivable within respective recesses 237, 238 of the stabilizer sleeve 230. In some embodiments, the pendulum sleeve 220 may be coupled to the stabilizer sleeve 230 via mud seals 271, 272 at first and second ends, respectively to prevent leakage of fluid. The mud seals 271, 272 may be, but are not limited to, metal to metal seals or other suitable sealing features/elements.

In some embodiments, the sub apparatus 200 may include one or more strip separators 261 (see FIG. 2 and FIG. 8) positioned within the annulus space (or chamber) 260 between the pendulum sleeve 220 and the stabilizer sleeve 230 for defining a plurality of distinct chambers 260*a*, 260*b*, 260*c* (described further below with reference to FIG. 8) extending between the pendulum sleeve 220 and the stabilizer sleeve 230. The one or more strip separators 261 can include but are not limited to elastomeric strip separators. The strip separators 261 may be positioned within a recess in one of the pendulum sleeve 220 or the stabilizer sleeve 230, and a corresponding projection/protrusion on the other of the pendulum sleeve 220 or the stabilizer sleeve 230. The strip separator(s) 261 may extend into the recess securing the strip separator in place. In other aspects, the strip separator(s) may be retained in place by other suitable means. The strip separators 261 can be useful to stop leaking pressure surrounding the pendulum 240.

As shown in FIGS. 4A-4B (see also FIGS. 2, 7, and 9A-9B) in various embodiments, the pendulum sleeve 220 can include a plurality of apertures or openings 222 defining fluid pathways (see FIGS. 2, 4C and 7) extending from the inner surface 221*i* of the pendulum sleeve 220 to an outer surface 220*o* (see FIGS. 4B and 4C) of the pendulum sleeve 220. The apertures 222 can define fluid pathways between the pendulum recess 224 of the pendulum sleeve 220 and the annulus 260 between the pendulum sleeve 220 and an inner surface 230*i* of the stabilizer sleeve 230 in the assembled sub apparatus 200. In some embodiments, a non-limiting example of which is depicted in FIG. 5C, the one or more apertures 222 (only three are marked for references and are collectively referred as apertures 222) distributed radially at the bottom end of the pendulum sleeve 220.

The apertures 222 remain covered or blocked or sealed by the bottom portion of the pendulum 240 when the inner pipe 210 is substantially vertical (e.g., aligned to the vertical axis 102), as depicted in FIG. 9A. However, when the inner pipe 210 is tilted relative to the vertical axis 102, the pendulum 240 shifts and thereby uncovers or exposes one or more apertures 222 on a side of the pendulum sleeve 220 opposite the direction the inner pipe 210 is tilted (which corresponds to the direction drill string is also tilting). The exposure of the apertures 222 allows for fluid communication between the pendulum recess 224 of the pendulum sleeve 220 and the annulus 260, as shown in FIGS. 9A and 9B and further described in detail with reference to those figures.

Figure 5B:
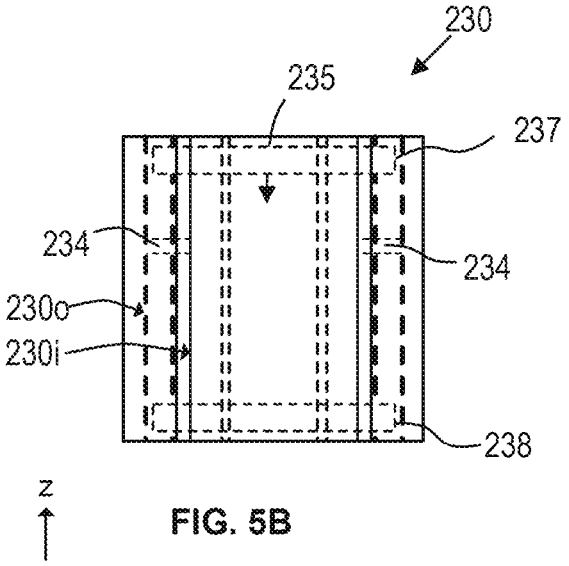
FIGS. 5A, 5B, and 5C are a perspective view, an elevation view, and a plan view, respectively, of a stabilizer sleeve of the pendulum sub assembly of FIG. 2, according to embodiments of the disclosure.
Figure 5A:
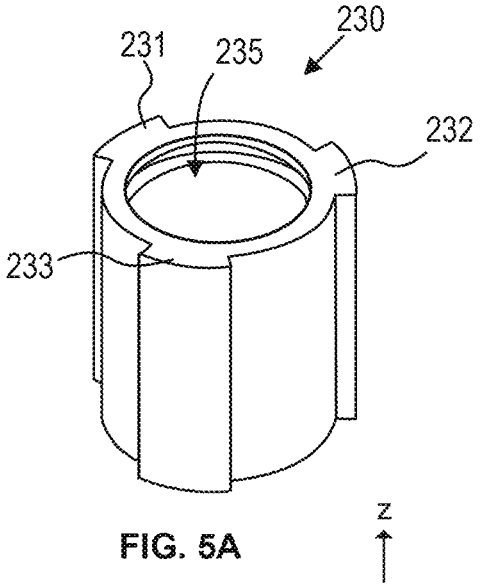
Figure 5C:
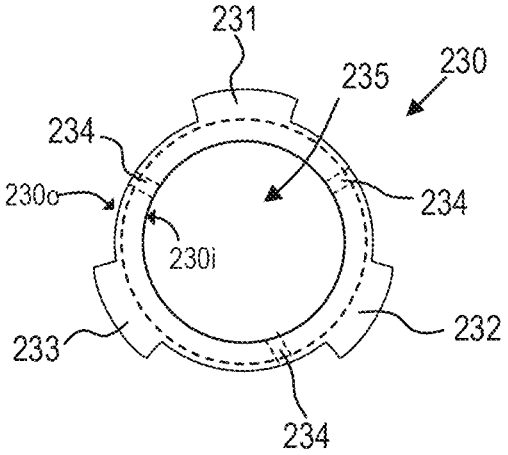

FIGS. 5A-5C depict additional views of a non-limiting exemplary stabilizer sleeve 230 of the sub apparatus 200 that can include an inner region or a bore through (or opening) 235 extending along a longitudinal axis from a first end (e.g. top end) to a second end (e.g. bottom end) opposite the first end of the stabilizer sleeve 230. The bore through 235 can be sized to receive the pendulum sleeve 220. The stabilizer sleeve 230 can include recesses or cut-outs 237, 238 sized and shaped to receive the flanges 227, 228 of the pendulum sleeve 220. The recess or cut-outs 237, 238 can be located at a top portion and at a bottom portion, respectively, of the stabilizer sleeve 230. The recesses 237, 238 can have a diameter greater than the diameter of the remainder of the bore through 235.

In some embodiments, the stabilizer sleeve 230 may include one or more fins 231, 232, 233 which may each have a diameter approximately equal to a diameter of the wellbore (e.g., 105 in FIG. 1) for aiding in retaining the sub apparatus 200 in a central position within the wellbore (e.g., 105). The fins 231, 232, 233 can extend outwards from the outer surface 2300 of the stabilizer sleeve 230. The fins 231, 232, 233 may be radially distributed and may extend along a portion of or all of the length of the stabilizer sleeve 230. In some embodiments, the stabilizer sleeve 230 may also include one or more apertures or leak holes 234 (see FIG. 2 and FIG. 5B-5C). Upon the straightening of the inner pipe 210, causing the apertures 222 to become covered or sealed by the pendulum 240, one or more apertures 234 located adjacent one or more distinct chambers 260 may allow for high pressure that has flowed from the inner region 215 of the inner pipe 210 to exit the one or more distinct chambers 260, thereby releasing the pressure that was built up when the inner pipe 210 (see FIG. 9B) was tilted. The apertures 234 may have a smaller diameter than the apertures (e.g., 222) in the bottom region of the pendulum sleeve 220.

Figure 8:
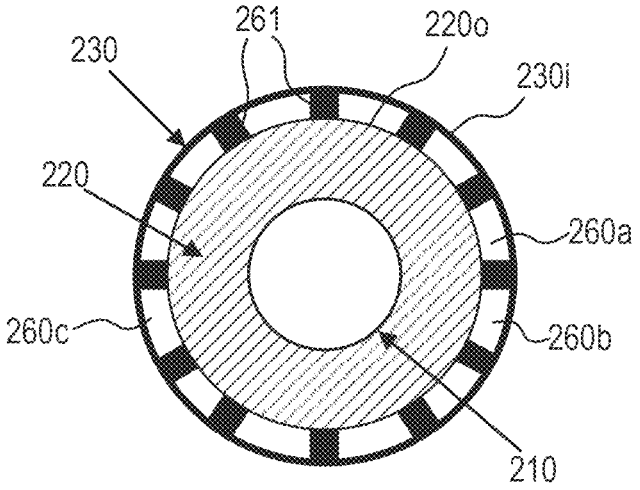
FIG. 8 is a top schematic view depicting a plurality of distinct chambers between the pendulum sleeve and a stabilizer sleeve of the pendulum sub assembly of FIG. 2, according to embodiments of the disclosure.

As depicted in FIG. 8, in some embodiments, the stabilizer sleeve 230 and the pendulum sleeve 220 can define the plurality of distinct chambers 260 therebetween. For example, the plurality of distinct chambers 260 can be defined by the outer surface 220*o* of the pendulum sleeve 220, the inner surface 230*i* of the stabilizer sleeve 230, and two elastomeric strip separators 261. More or fewer distinct chambers may be used without departing from the scope of the present disclosure.

When the pendulum 240 uncovers one or more of apertures 222, a fluid pathway through the sub apparatus 200 may extend from the inner region 215 of the inner pipe 210, through the inner pipe (via aperture(s) 213) into an interior region of the pendulum 240, through the pendulum 240 (via aperture(s) 244) into the pendulum recess 224 of the pendulum sleeve 220, through the pendulum sleeve 220 (via aperture(s) 222), and into the one or more of the distinct chambers 260. In addition, aperture(s) 234 may allow for the high pressure within the one or more distinct chambers 260 to bleed off when the inner pipe 210 (and thereby the drill pipe) has returned to a vertical position in which the pendulum 240 again covers the apertures 222. In some embodiments, a diameter of the aperture 234 extending from one of the plurality of chambers 260 to an exterior of the stabilizer sleeve 230 may be smaller than the diameter of a fluid pathway (e.g., 213) extending through the inner pipe 210, the pendulum member 240, and/or from the interior of the pendulum sleeve 220 to the plurality of chambers between the stabilizer sleeve 230 and the pendulum sleeve 220. The difference in diameters of the apertures can control bleeding off of the pressure between the distinct chambers 260 and the annulus space between the wellbore and the sub apparatus 200.

Figure 6B:
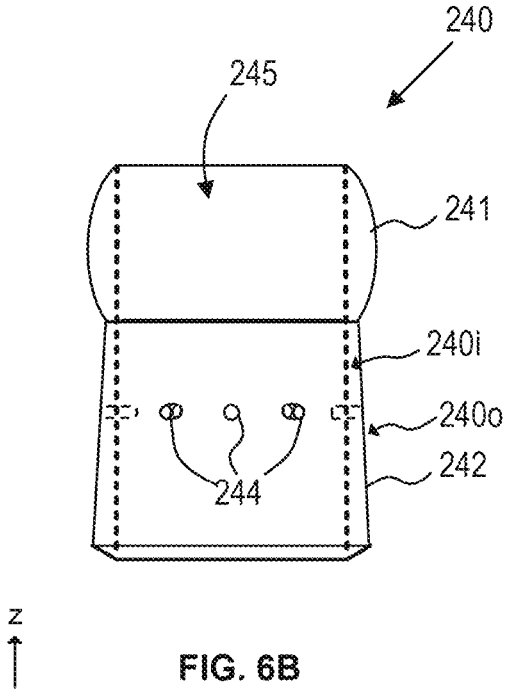
FIGS. 6A, 6B, and 6C are a perspective view, an elevation view, and a plan view, respectively, of a pendulum sleeve of the pendulum sub assembly of FIG. 2, according to embodiments of the disclosure.
Figure 6A:
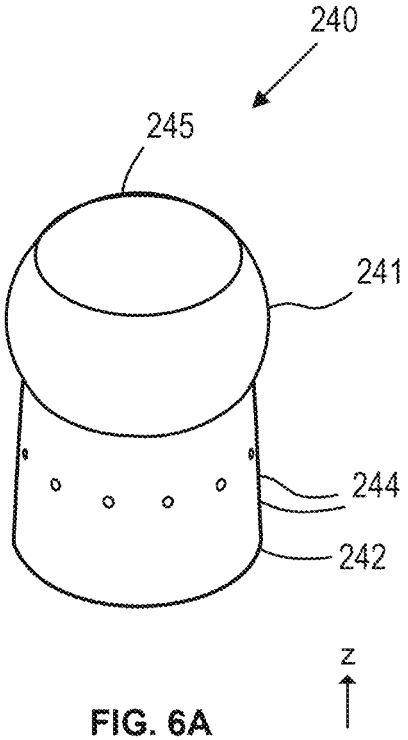
Figure 6C:
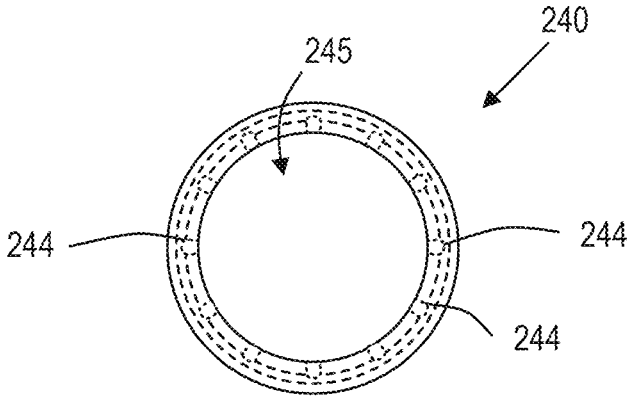

FIGS. 6A-6C depict a non-limiting exemplary pendulum member 240 of the sub apparatus 200. The pendulum member 240 can be sized and shaped to be received within a portion of the pendulum sleeve 220. The pendulum member 240 can include an inner region or through hole (or opening) 245 extending along a longitudinal axis from a first end (e.g. a top end) to a second end (e.g. a bottom end) of the pendulum member 240. The through hole 245 can be sized and shaped to receive the inner pipe 210 therethrough. The inner pipe 210 can extend through the through hole 245 of the pendulum member 240. As described above, the pendulum member 240 can be sized and shaped to be positioned within the pendulum recess 224, and may be sized and shaped to move within the pendulum recess 224 of the pendulum sleeve 220.

The pendulum 240 can include a plurality of apertures or openings 244 extending from the inner region 245 of the pendulum member 240 to the exterior surface of the pendulum 240. While twelve apertures 244 are depicted in FIG. 6C fewer or more apertures may be included without departing from the scope of the present disclosure. In addition, the apertures 244 in the pendulum 240 may provide a fluid pathway between (i) a region defined by the inner surface of the pendulum 240 and the outer surface of the inner pipe and (ii) the region between the outer surface of the pendulum 240 and the inner surface of the pendulum sleeve 220. During a drilling operation, the pendulum 240 can rotate about its spherical top portion within the pendulum recess 224 of the pendulum sleeve 220. The position of the pendulum 240, for example, the bottom portion of the pendulum 240) can determine if the aperture(s) 222 are covered or exposed thereby determining if there is fluid communication from (i) the region between the outer surface of the pendulum 240 and the inner surface of the pendulum sleeve 220 and (ii) one or more individual chambers 260 between the outer surface of the pendulum sleeve 220 and the inner surface 230; of the stabilizer sleeve 230. The fluid communication between different components is further discussed in detail below with respect to FIGS. 9A and 9B.

FIG. 9A illustrates an enlarged cross-section of a portion of the sub apparatus 200 with the inner pipe 210 in a vertical or substantially vertical position. The relative dimensions are exaggerated for illustration purposes and explain the concepts without limiting the scope of the present disclosure. In FIG. 9A, the inner pipe 210 is in a substantially vertical position (e.g., aligned with the vertical axis 102 of the wellbore 105). Although, the apertures 213 may be filled with the pressurized fluid 901, the pressurized fluid 901 may not flow through the apertures 244 of the pendulum 240. Furthermore, the pendulum 240 is substantially vertical and the apertures 222 in the pendulum sleeve 220 may be covered or sealed by a bottom portion 246 of the pendulum 240 further preventing pressure variations in combination with the required fluid communication that would permit the pressurized fluid 901 to flow from the aperture 213 to the apertures 222 and into one or more distinct chambers 260.

During drilling, drilling mud (a non-limiting example of a pressurized fluid 901) may be pumped through the drilling pipe (e.g., 111 in FIG. 1) coupled to the sub apparatus 200 and may flow through the inner region 215 of the inner pipe 210. The pressure within the inner pipe 210 may be elevated relative to the pressure outside of the apparatus 200 (e.g. in the annulus 270 between the apparatus 200 and the wellbore 105). When the inner pipe 210 is positioned in a substantially vertical position or vertical position (e.g., as depicted in FIG. 9A), the fluid and corresponding higher pressure within the inner pipe 210 may not flow through the apertures in the inner pipe 210 and the pendulum 240 due to the apertures 213 in the inner pipe 210 and the apertures 222 in the bottom of the pendulum sleeve 220 being sealed by the bottom portion 246 of the outer surface of the pendulum 240. However, when the inner pipe 210 is tilted away from the substantially vertical position or vertical position during the drilling operation (corresponding to a tilting of the drill pipe 111 of the drill string) due to variations in geological formations, for example, the pendulum 240 may shift and unseal one or more apertures (e.g. 222) thereby creating fluid communication through a fluid pathway from the inner pipe 210 to the outside of the apparatus 200, further discussed with respect to FIG. 9B below.

FIG. 9B illustrates a further enlarged cross-section with the inner pipe 210 in a tilted position (e.g., more than 1 degree) relative to the vertical axis (e.g., 102 of the wellbore 105). FIG. 9B further illustrates a non-limiting example of fluid flow between different components caused due to the tilted inner pipe 210. The relative dimensions are also exaggerated for illustration purposes and explain the concepts without limiting the scope of the present disclosure.

As shown in FIG. 9B, when the inner pipe 210 becomes tilted by a tilt angle θ, (e.g. tilted at approximately 1 degree or more from the vertical axis 102), the pendulum sleeve 220 may be initially forced to tilt as well. While the inner pipe 210 and the pendulum sleeve 220 are in a tilted position, the pendulum 240 may move freely relative to the inner pipe 210 and the pendulum sleeve 220 such that it hangs or is positioned in response to the force of gravity. With the inner pipe 210 and the pendulum sleeve 220 in a tilted position and the pendulum 240 positioned in response to gravitational force, one or more of apertures 222 in the bottom region of the pendulum sleeve 220 may become uncovered or exposed as the bottom portion 246 of the pendulum 240 moves away from and unseals the aperture(s) 222. The exposure of the aperture(s) 222 in the bottom region of the pendulum sleeve 220 allows the pressurized fluid 901 from the inner region 215 of the inner pipe 210 to flow out of the aperture 213 of the inner pipe 210, through the apertures 244 in the pendulum 240, and into the pendulum recess 224 of the pendulum sleeve 220 between the outer surface of the pendulum 240 and the inner surface 220; of the pendulum sleeve 220. The pressurized fluid 901 may then flow through the apertures 222 in the bottom region of the pendulum sleeve 220 into one or more distinct chambers (e.g., 260) between the pendulum sleeve 220 and the stabilizer sleeve 230 (see also FIG. 8). The increased pressure within the distinct chambers (e.g., 260) applies a force to the side of the pendulum sleeve 220 (and thereby the inner pipe 210) in a direction opposite the direction the inner pipe 210 and pendulum sleeve 220 are tilted. The force applied by the high-pressure build-up in the one or more distinct chambers (e.g., 260) thereby applies a straightening force to the inner pipe 210 and pendulum sleeve 220, forcing the inner pipe 210 back to the vertical position (e.g., aligned with the vertical axis 102). This allows the inner pipe 210 to correct any deviations from a desired vertical wellbore 105 that may be caused due to straying away from the vertical position.

As the inner pipe 210 and the pendulum sleeve 220 are moving back to the vertical position, the apertures 234 in the stabilizer sleeve 230 allow the pressurized fluid to flow from the distinct chambers (e.g., 260) into the annulus 270 between the wellbore 105 and the stabilizer sleeve 230. Additionally, as the pendulum sleeve 220 is moving back to the vertical position, the bottom portion 246 of the pendulum 240 starts covering the aperture 222*c* thereby stopping the flow of the pressurized fluid 901 into the one or more chambers (e.g., 260*c*) between the pendulum sleeve 220 and the stabilizer sleeve 230. Once the flow of pressurized fluid 901 into the one or more chambers (e.g., 260*c*) stops, the release of the fluid from the chambers (e.g., 260*c*) can occur, e.g., through the aperture 234, so that the pressure outside the inner pipe 210 is equalized and the sub apparatus 200 is ready for use if and when another deviation from vertical occurs. The smaller diameter of the apertures 234 in the stabilizer sleeve 230 relative to the apertures (e.g., 222) in the bottom region of the pendulum sleeve 220 may allow for pressure to continue rise while the inner pipe 210 and the stabilizer sleeve 230 remain tilted, while allowing for pressure to release or dissipate from the distinct chamber(s) (e.g., 260*c*) once the inner pipe 210 and pendulum sleeve 220 are substantially vertical or vertical.

In various embodiments, the pendulum member 240, the pendulum sleeve 220, and the stabilizer sleeve 230 can each comprise a material having a coefficient of thermal expansion within ten percent of one another. The pendulum member 240, the pendulum sleeve 220, and the stabilizer sleeve 230 can each comprise steel or stainless steel or similar hard wearing materials. The present disclosure is not limited to a particular material and other appropriate materials or a combination of materials can be used for different components.

The use of the terms "a" and "an" and "the" and similar referents in the context of describing the invention (especially in the context of the following claims) are to be construed to cover both the singular and the plural, unless otherwise indicated herein or clearly contradicted by context. Directional references such as "up," "down," "top," and "bottom," among others, are intended to refer to the orientation as illustrated and described in the figure (or figures) to which the components and directions are referencing. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, or gradients thereof, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, the nearness of completion will be so as to have the same overall result as if absolute and total completion were obtained.

Preferred embodiments of this invention are described herein. The invention is susceptible to various modifications and alternative constructions, and certain shown exemplary embodiments thereof are shown in the drawings and have been described above in detail. Variations of those preferred embodiments, within the spirit of the present invention, may become apparent to those of ordinary skill in the art upon reading the foregoing description. The inventors expect skilled artisans to employ such variations as appropriate, and the inventors intend for the invention to be practiced otherwise than as specifically described herein. Accordingly, it should be understood that there is no intention to limit the invention to the specific form or forms disclosed, but on the contrary, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A drilling sub apparatus, the apparatus comprising:

an inner pipe having a through hole and a plurality of apertures extending from an inner surface of the inner pipe to an outer surface of the inner pipe;

a pendulum sleeve having a pendulum recess, wherein the inner pipe extends through the pendulum recess, wherein the pendulum sleeve has a plurality of apertures extending from an inner surface of the pendulum sleeve to an outer surface of the pendulum sleeve;

a stabilizer sleeve having a through hole, wherein at least a portion of the pendulum sleeve is located within the stabilizer sleeve, and wherein the stabilizer sleeve and the pendulum sleeve define a plurality of chambers therebetween;

a pendulum member having a through hole and a plurality of apertures, wherein the pendulum member is positioned within the pendulum recess of the pendulum sleeve, the inner pipe extends through the through hole of the pendulum member, and the plurality of apertures extend from an inner surface of the pendulum member to an outer surface of the pendulum member; and wherein a bottom portion of the pendulum member covers the plurality of apertures of the pendulum sleeve when the pendulum sleeve is in a substantially vertical position, and wherein the pendulum member is configured to move within the pendulum recess of the pendulum sleeve when the pendulum sleeve is in a non-vertical position, wherein in the non-vertical position one or more of the plurality of apertures of the pendulum sleeve are not sealed by the bottom portion of the pendulum member for allowing a fluid to flow from the inner pipe to one or more of the plurality of chambers between the pendulum sleeve and the stabilizer sleeve, wherein the fluid within the one or more of the plurality of chambers between the pendulum sleeve and the stabilizer sleeve exert a force on the pendulum sleeve and the inner pipe.

2. The apparatus according to claim 1, wherein the plurality of apertures of the inner pipe are vertically offset from the plurality of apertures of the pendulum member.

3. The apparatus according to claim 1, wherein the plurality of apertures of the pendulum sleeve are located within a bottom portion of the pendulum sleeve and are vertically offset from the plurality of apertures of the pendulum member.

4. The apparatus according to claim 1, wherein each aperture of the pendulum sleeve defines a fluid passageway between (a) an annulus between an outer surface of the pendulum member and the inner surface of pendulum sleeve and (b) a chamber of the plurality of chambers.

5. The apparatus according to claim 1, further comprising a plurality of elastomeric members between the stabilizer sleeve and the pendulum sleeve that partially define each of the plurality of chambers.

6. The apparatus according to claim 1, wherein the stabilizer sleeve comprises a plurality of apertures, each aperture extending from one of the plurality of chambers to an outer surface of the stabilizer sleeve.

7. The apparatus according to claim 6, wherein a diameter of each of the plurality of apertures extending from one of the plurality of chambers to an outer surface of the stabilizer sleeve is smaller than a diameter of each of the plurality of apertures extending through the inner pipe, the pendulum member, the pendulum sleeve to the plurality of chambers between the stabilizer sleeve and the pendulum sleeve.

8. The apparatus according to claim 1, wherein the pendulum member, the pendulum sleeve, and the stabilizer sleeve each comprise a material having a coefficient of thermal expansion within ten percent of one another.

9. The apparatus according to claim 1, wherein the pendulum member, the pendulum sleeve, and the stabilizer sleeve each comprise steel or stainless steel or similar hard wearing materials.

10. The apparatus according to claim 1, wherein the stabilizer sleeve comprises an outer surface having one or more stabilizer fins thereon.

11. A drill string for drilling, the drill string comprising:

a drill bit having a first end and a second end, wherein the first end is adapted to drill;

a drilling sub apparatus having a first end and a second end, the drilling sub apparatus comprising:

an inner pipe having a through hole and a plurality of apertures extending from an inner surface of the inner pipe to an outer surface of the inner pipe;

a pendulum sleeve having a through hole and a pendulum recess extending outward from the through hole, wherein at least a portion of the inner pipe extends through the through hole of the pendulum sleeve, wherein the pendulum sleeve has a plurality of apertures extending from an inner surface of the pendulum sleeve to an outer surface of the pendulum sleeve;

a stabilizer sleeve having a through hole, wherein at least a portion of the pendulum sleeve is located within the through hole of the stabilizer sleeve, and wherein the stabilizer sleeve and the pendulum sleeve define a plurality of chambers therebetween;

a pendulum member having a through hole and a plurality of apertures, wherein at least a portion of the pendulum member is positioned within the pendulum recess of the pendulum sleeve, at least a portion of the inner pipe extends through the through hole of the pendulum member, and the plurality of apertures extend from an inner surface of the pendulum member to an outer surface of the pendulum member;

wherein the pendulum member is configured to move within the pendulum recess of the pendulum sleeve between (a) a first position in which a bottom portion of the pendulum member covers the plurality of apertures of the pendulum sleeve such that an inner region of the inner pipe is not in fluid communication with the plurality of chambers and (b) a second position in which one or more of the plurality of apertures of the pendulum sleeve are not sealed by the bottom portion of the pendulum member such that an inner region of the inner pipe is in fluid communication with one or more of the plurality of chambers; and a bottom hole assembly having a first end and a second end, wherein the first end of the bottom hole assembly is coupled to the second end of the sub apparatus and the second end of the bottom hole assembly is coupled to one or more pipes.

12. The drill string according to claim 11, the plurality of apertures of the inner pipe are vertically offset from the plurality of apertures of the pendulum member.

13. The drill string according to claim 11, the plurality of apertures of the pendulum sleeve are located within a bottom portion of the pendulum sleeve and are vertically offset from the plurality of apertures of the pendulum member.

14. The drill string according to claim 11, a bottom portion of the pendulum member covers the plurality of apertures of the pendulum sleeve when the pendulum sleeve is in the first position.

15. The drill string according to claim 11, further comprising a plurality of elastomeric members between the stabilizer sleeve and the pendulum sleeve, wherein the plurality of elastomeric members define the plurality of chambers.

16. The drill string according to claim 11, wherein the stabilizer sleeve comprises a plurality of apertures, each aperture extending from one of the plurality of chambers to an outer surface of the stabilizer sleeve.

17. The drill string according to claim 11, wherein a diameter of each of the plurality of apertures extending from one of the plurality of chambers to an outer surface of the stabilizer sleeve is smaller than a diameter of each of the plurality of apertures extending through the inner pipe, the pendulum member, the pendulum sleeve to the plurality of chambers between the stabilizer sleeve and the pendulum sleeve.

18. The drill string according to claim 11, wherein the stabilizer sleeve comprises an outer surface having one or more stabilizer fins thereon.

19. A method of drilling a well, the method comprising:

providing a sub apparatus, the sub apparatus comprising:

an inner pipe having a through hole and a plurality of apertures extending from an inner surface of the inner pipe to an outer surface of the inner pipe;

a pendulum sleeve having a through hole and a pendulum recess extending outward from the through hole, wherein at least a portion of the inner pipe extends through the through hole of the pendulum sleeve, wherein the pendulum sleeve has a plurality of apertures extending from an inner surface of the pendulum sleeve to an outer surface of the pendulum sleeve;

a stabilizer sleeve having a through hole, wherein at least a portion of the pendulum sleeve is located within the through hole of the stabilizer sleeve, and wherein the stabilizer sleeve and the pendulum sleeve define a plurality of chambers therebetween;

a pendulum member having a through hole and a plurality of apertures extending between an inner surface and an outer surface of the pendulum member, wherein at least a portion of the pendulum member is positioned within the pendulum recess of the pendulum sleeve, at least a portion of the inner pipe extends through the through hole of the pendulum member, and wherein the pendulum member is configured to move within the pendulum recess of the pendulum sleeve between a first position and a second position; and in response to the inner pipe moving from the first position to the second position, wherein in the second position the inner pipe is tilted away from vertical, the pendulum member automatically shifting to uncover one or more of the plurality of apertures in the pendulum sleeve for allowing a fluid to flow from an inner region of the inner pipe to one or more of the plurality of chambers for providing a force on the inner pipe in a direction opposite the direction of the tilt of the inner pipe for forcing the inner pipe to return to the first position.

20. The method of claim 19, further comprising:

in response to the inner pipe returning to the first position, automatically releasing the fluid from the one or more of the plurality of chambers through one or more apertures in the stabilizer sleeve.

21. The method of claim 20, wherein the step of the pendulum member automatically shifting to uncover one or more of the plurality of apertures in the pendulum sleeve for allowing a fluid to flow from an inner region of the inner pipe to one or more of the plurality of chambers for providing a force on the inner pipe in a direction opposite the direction of the tilt of the inner pipe for forcing the inner pipe to return to the first position, further comprising the pendulum member automatically shifting by way of a gravitational force and without the use of electronics for controlling the pendulum member.

* * * * *